US010871164B2

(12) United States Patent
Yamashita et al.

(10) Patent No.: US 10,871,164 B2
(45) Date of Patent: Dec. 22, 2020

(54) CENTRIFUGAL COMPRESSOR

(71) Applicant: MITSUBISHI HEAVY INDUSTRIES COMPRESSOR CORPORATION, Tokyo (JP)

(72) Inventors: Shuichi Yamashita, Tokyo (JP); Akihiro Nakaniwa, Tokyo (JP); Hirofumi Higuchi, Hiroshima (JP)

(73) Assignee: MITSUBISHI HEAVY INDUSTRIES COMPRESSOR CORPORATION, Tokyo (JP)

( * ) Notice: Subject to any disclaimer, the term of this patent is extended or adjusted under 35 U.S.C. 154(b) by 331 days.

(21) Appl. No.: 16/088,365

(22) PCT Filed: Mar. 23, 2017

(86) PCT No.: PCT/JP2017/011599
§ 371 (c)(1),
(2) Date: Sep. 25, 2018

(87) PCT Pub. No.: WO2017/170083
PCT Pub. Date: Oct. 5, 2017

(65) Prior Publication Data

US 2020/0300252 A1 Sep. 24, 2020

(30) Foreign Application Priority Data

Mar. 30, 2016 (JP) ..... 2016-067126

(51) Int. Cl.
*F04D 29/42* (2006.01)
*F04D 17/12* (2006.01)
(Continued)

(52) U.S. Cl.
CPC ..... *F04D 17/122* (2013.01); *F04D 29/441* (2013.01); *F04D 29/284* (2013.01);
(Continued)

(58) Field of Classification Search
CPC .... F04D 17/122; F04D 29/42; F04D 29/4213; F04D 29/441; F04D 29/284; F04D 29/286; F05D 2250/51
See application file for complete search history.

(56) References Cited

U.S. PATENT DOCUMENTS 4,493,611 A * 1/1985 Funakoshi ..... F01D 9/026 415/199.1
4,579,509 A * 4/1986 Jacobi ..... F01D 17/143 415/199.1
(Continued)

FOREIGN PATENT DOCUMENTS

JP H07-167099 A 7/1995
JP H09-144698 A 6/1997
(Continued)

OTHER PUBLICATIONS

International Search Report issued in corresponding International Application No. PCT/JP2017/011599 dated May 23, 2017 (2 pages).
(Continued)

*Primary Examiner* — Ninh H. Nguyen
(74) *Attorney, Agent, or Firm* — Osha Bergman Watanabe & Burton LLP

(57) ABSTRACT

The present invention provides a centrifugal compressor (1) including: a first casing (19); a second casing (20) which is disposed on a downstream side of the first casing (19) and has an outer diameter larger than an outer diameter of the first casing; a first impeller (3*a*) which is disposed on a radially inner side of the first casing; a first return flow path (29*a*) which is disposed on a radially inner side of the first casing; a second impeller (3*b*) which is disposed on a radially inner side of the second casing and connected to a downstream side of the first return flow path (29*a*); an intermediate suction flow path (10) which is disposed on the radially inner side of the second casing and additionally
(Continued)

supplies the fluid to a flow path between the first return flow path (29*a*) and the second impeller (3*b*); and a second return flow path (29*b*) which is disposed on the radially inner side of the second casing (20), wherein an outer diameter of the intermediate suction flow path (10) and an outer diameter of the second return flow path (29*b*) are larger than the outer diameter of the first casing (19).

2 Claims, 1 Drawing Sheet

(51) Int. Cl.
*F04D 29/44* (2006.01)
*F04D 29/28* (2006.01)

(52) U.S. Cl.
CPC ..... *F04D 29/4213* (2013.01); *F05D 2250/36* (2013.01); *F05D 2250/51* (2013.01); *F05D 2250/52* (2013.01)

(56) References Cited

U.S. PATENT DOCUMENTS

| | | | | |
|---|---|---|---|---|
| 5,595,473 | A | 1/1997 | Nagaoka et al. | |
| 9,897,092 | B2 * | 2/2018 | Koga | F01D 9/026 |
| 2020/0300251 | A1 * | 9/2020 | Yamashita | F04D 17/122 |

FOREIGN PATENT DOCUMENTS

| | | | |
|---|---|---|---|
| JP | 2002-327700 | A | 11/2002 |
| JP | 2008-138577 | A | 6/2008 |
| JP | 2011-111990 | A | 6/2011 |

OTHER PUBLICATIONS

Written Opinion issued in corresponding International Application No. PCT/JP2017/011599 dated May 23, 2017 (10 pages).

* cited by examiner

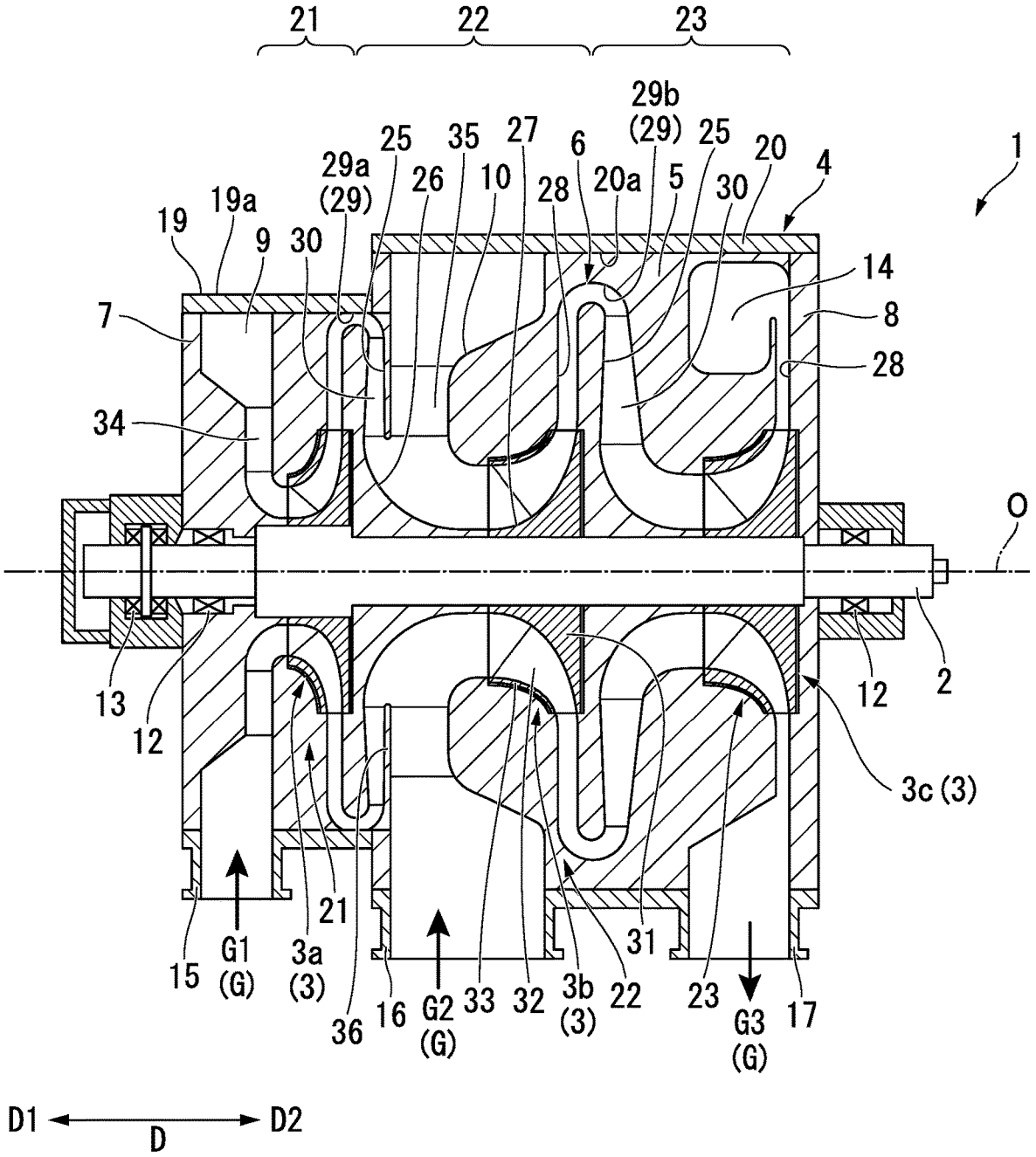
21
22
23
29b
(29)
25
35
27
6
25
20
4
1
29a
(29)
26
10
28
20a
5
30
19
19a
9
30
14
7
8
28
34
O
13
12
12
2
3c (3)
21
G1
(G)
3a
(3)
15
36
16
G2
(G)
33
32
3b
(3)
22
31
23
G3
(G)
17
D1
D
D2

CENTRIFUGAL COMPRESSOR

TECHNICAL FIELD

The present invention relates to a centrifugal compressor.

Priority is claimed on Japanese Patent Application No. 2016-67126, filed Mar. 30, 2016, the content of which is incorporated herein by reference.

BACKGROUND OF THE INVENTION

As a centrifugal rotary machine having a plurality of impellers provided on a rotating shaft and a casing covering the plurality of impellers, a horizontal split type single-shaft multistage centrifugal compressor in which the casing is divided into two to include an axis of the rotating shaft is known (for example, see Patent Document 1). One way to reduce the cost of such a centrifugal compressor is to reduce an outer diameter of the casing.

Also, when the multistage centrifugal compressor is used in a refrigerator, intermediate suction in which a gas introduced from the outside of a system of the refrigerator into a gas inlet is flown into the impeller of second and subsequent compression stages is carried out due to restrictions on operating conditions in the refrigerator.

DOCUMENTS OF RELATED ART

Patent Documents

Patent Document 1: Japanese Unexamined Patent Application, First Publication No. 2008-138577

SUMMARY OF THE INVENTION

Problems to be Solved by the Invention

However, in the centrifugal compressor having an intermediate suction flow path, a flow path cross-sectional area of the intermediate suction flow path is reduced by decreasing the outer diameter of the casing. Thus, the flow velocity of the gas increases and the friction loss increases, and thereby causing a problem in that the efficiency of the centrifugal compressor decreases.

Also, an outer diameter of a diffuser on or behind the intermediate suction flow path in which the flow rate of the gas increases becomes small, static pressure recovery at the diffuser becomes small and dynamic pressure at an outlet of the diffuser becomes large. Accordingly, there is a problem that the friction loss in a downstream portion (return vane or discharge scroll) from the diffuser becomes large.

It is an object of the present invention to provide a centrifugal compressor having an intermediate suction flow path capable of reducing cost while improving the efficiency of the centrifugal compressor.

Means to Solve the Problems

According to a first aspect of the present invention, a centrifugal compressor includes: a rotating shaft; a first casing which forms a cylindrical shape; a second casing which forms a cylindrical shape, is disposed on a downstream side of the first casing to be coaxial with the first casing, and has an outer diameter larger than an outer diameter of the first casing; a first impeller which is provided on the rotating shaft and disposed on a radially inner side of the first casing; a first return flow path which is disposed on a radially inner side of the first casing and guides a fluid flowing to a radially outer side from the first impeller toward a radially inner side; a second impeller which is provided on the rotating shaft, disposed on a radially inner side of the second casing, and connected to a downstream side of the first return flow path; an intermediate suction flow path which is disposed on the radially inner side of the second casing and additionally supplies the fluid to a flow path between the first return flow path and the second impeller; and a second return flow path which is disposed on the radially inner side of the second casing and guides the fluid flowing to the radially outer side from the second impeller toward the radially inner side, wherein an outer diameter of the intermediate suction flow path and an outer diameter of the second return flow path are larger than the outer diameter of the first casing.

According to such a constitution, it is possible to reduce cost while improving the efficiency of the centrifugal compressor. That is, a flow path cross-sectional area of the intermediate suction flow path in which the pressure of a gas is high and the flow rate of the gas is increased can be increased, and thereby realizing the decrease in the flow velocity and the reduction of the friction loss. On the other hand, it possible to reduce the cost of the centrifugal compressor by reducing the outer diameter of the first casing to be smaller than that of the second casing in consideration of the pressure of the gas and the flow rate of the gas.

The centrifugal compressor may further include: a third impeller which is provided on the rotating shaft, disposed on the radially inner side of the second casing, and connected to a downstream side of the second return flow path; and a discharge scroll which is disposed on the radially inner side of the second casing and in which the fluid flowing to the radially outer side from the third impeller is introduced, and an outer diameter of the discharge scroll may be larger than the outer diameter of the first casing.

According to such a constitution, a curvature of the discharge scroll can be increased, and separation of gas flowing through the discharge scroll can be minimized.

Effects of the Invention

According to the present invention, it is possible to reduce the cost while improving the efficiency of the centrifugal compressor. That is, since the flow path cross-sectional area of the intermediate suction flow path in which the pressure of the gas is high and the flow rate of the gas is increased can be increased, the flow velocity can be lowered, and the friction loss can be reduced. On the other hand, it possible to reduce the cost of the centrifugal compressor by reducing the outer diameter of the first casing to be smaller than that of the second casing in consideration of the pressure of the gas and the flow rate of the gas.

BRIEF DESCRIPTION OF DRAWINGS

FIG. 1 is a cross-sectional view showing a constitution of a centrifugal compressor according to an embodiment of the present invention.

EMBODIMENTS FOR CARRYING OUT THE INVENTION

Hereinafter, a centrifugal compressor according to an embodiment of the present invention will be described in detail with reference to the drawings.

A centrifugal compressor of the embodiment is constituted as a so-called barrel type single-shaft multistage centrifugal compressor. The centrifugal compressor of the embodiment rotates an impeller via a rotating shaft by a driving device which is not shown in the drawing, thereby applying a centrifugal force to a gas supplied to the impeller to compress the gas.

As shown in FIG. 1, the centrifugal compressor 1 of the embodiment includes: a rotating shaft 2 which rotates around an axis O; a plurality of impellers 3 which are provided on the rotating shaft 2; a cylindrical casing 4 (cabin) which forms an outer shell of the centrifugal compressor 1; and a diaphragm 5 which is accommodated in the casing 4 and covers a circumference of the rotating shaft 2 to form a flow path 6 which connects spaces between the impellers 3. The centrifugal compressor 1 has three compression stages 21, 22 and 23.

The centrifugal compressor 1 further includes: a suction nozzle 15 which introduces a gas G1 into the centrifugal compressor 1; an intermediate suction nozzle 16 which introduces a gas G2 into an intermediate suction flow path 10; and a discharge nozzle 17 which discharges a compressed gas G3.

The casing 4 of the embodiment is a horizontal split type that is divided into two to include the axis O.

In the following description, a direction in which the axis O of the rotating shaft 2 extends is an axial direction D. Further, a direction orthogonal to the axis O is defined as a radial direction, a side which is away from the axis O in the radial direction is referred to as a radially outer side, and a side which approaches the axis O in the radial direction is referred to as a radially inner side. In the axial direction D, the left side of FIG. 1 is referred to as an upstream side D1 and the right side of FIG. 1 is referred to as a downstream side D2.

The diaphragm 5 is divided into a plurality of parts corresponding to the compression stages of the centrifugal compressor 1.

A first casing head 7 is disposed on the upstream side D1 of the diaphragm 5 with a gap therebetween. A suction flow path 9 which introduces the external gas G1 into the flow path 6 via the suction nozzle 15 is formed between the first casing head 7 and the diaphragm 5.

A second casing head 8 is disposed on the downstream side D2 of the diaphragm 5.

The casing 4 of the embodiment includes: a first casing 19 disposed on the upstream side D1; and a second casing 20 disposed on the downstream side D2 of the first casing 19 to be coaxial with the first casing 19. The first casing 19 and the second casing 20 are formed in a cylindrical shape extending generally along the axis O.

An outer diameter of the second casing 20 is larger than an outer diameter of the first casing 19. An inner circumferential surface 20*a* of the second casing is disposed on the radially outer side of an outer circumferential surface 19*a* of the first casing.

The rotating shaft 2 extends to pass through the inside of the casing 4 along the axis O. A journal bearing 12 and a thrust bearing 13 are provided at both ends of the casing 4 in the axial direction D. The rotating shaft 2 is supported to be rotatable around the axis O by the journal bearing 12 and the thrust bearing 13.

The centrifugal compressor 1 of the embodiment includes: a first compression stage 21; a second compression stage 22; and a third compression stage 23, in order from the upstream side D1 to the downstream side D2. Each of the compression stages includes: an introduction flow path 25; a curved flow path 26; a compression flow path 27 (impeller 3); a diffuser flow path 28; and a return flow path 29 (return bend). The introduction flow path 25 is a flow path which guides the gas G from the radially outer side of the axis O toward the radially inner side thereof. The curved flow path 26 is a flow path which is connected to the radially inner side of the introduction flow path 25 on the downstream side, extends to be curved from a position connected to the introduction flow path 25 toward the downstream side D2, and supplies the gas G to the impeller 3. The compression flow path 27 is a flow path which compresses the gas G. The diffuser flow path 28 is a flow path which guides the compressed gas G from the radially inner side toward the radially outer side. The return flow path 29 is a flow path which guides the gas G flowing to the radially outer side toward the radially inner side.

The impeller 3 includes: a disk 31 having a substantially circular cross section when seen in the axial direction D; a plurality of blades 32 provided on a surface of the disk 31 on the upstream side D1; and a shroud 33 which covers the plurality of blades 32 from the upstream side D1.

Each of the impellers 3 may be an open impeller without the shroud.

In the first compression stage 21, the radially outer side which is the upstream side of the introduction flow path 25 is connected to the suction flow path 9.

The introduction flow path 25 in the second and subsequent compression stages 22 and 23 communicates with a downstream end of the return flow path 29 in the previous stage. That is, a flowing direction of the gas G which has passed through the return flow path 29 is changed so that the gas G is guided to the radially inner side and then directed toward the downstream side D2 along the axis O.

The introduction flow path 25 is a flow path which guides the gas G directed toward the radially inner side via the return flow path 29 to the impeller 3. An end of the introduction flow path 25 on radially outer side communicates with the return flow path 29. An end of the introduction flow path 25 on radially inner side communicates with the impeller 3 (compression flow path 27) via the curved flow path 26.

A plurality of return vanes 30 are provided in the introduction flow path 25. The plurality of return vanes 30 are radially disposed around the axis O in the introduction flow path 25. The return vanes 30 straighten the gas G into a flow which is directed to the radially inner side.

An inlet guide vane 34 capable of changing an inclination of the vanes by a mechanism which is not shown in the drawing is provided on the upstream side of the first compression stage 21.

The curved flow path 26 is a flow path which is connected to the radially inner side of the introduction flow path 25 on the downstream side, and extends to be curved from the position connected to the introduction flow path 25 toward the downstream side D2. Therefore, a flow of the gas G directed toward the radially inner side changes to a flow toward the downstream side D2. The gas G flowing to the downstream side D2 is guided to the impeller 3 and compressed.

The compression flow path 27 is a flow path surrounded by surfaces of the impeller 3 on the upstream side D1 of the disk 31 and the downstream side D2 of the shroud 33, and a pair of blades 32 adjacent in a circumferential direction. A cross-sectional area of the compression flow path 27 gradually decreases from the radially inner side toward the radially outer side. Therefore, the gas G flowing through the compression flow path 27 in a state in which the impeller 3 is rotating is gradually compressed to a high pressure.

The diffuser flow path 28 is a flow path which extends from the radially inner side toward the outside. An end of the diffuser flow path 28 on radially inner side communicates with an end of the compression flow path 27 on the radially outer side.

The return flow path 29 reverses the flowing direction of the gas G flowing from the radially inner side toward the radially outer side through the diffuser flow path 28. One end side (the upstream side D1) of the return flow path 29 communicates with the diffuser flow path 28, and the other end side (the downstream side D2) communicates with the introduction flow path 25.

The end of the diffuser flow path 28 on the radially outer side in the third compression stage 23 is connected to a discharge scroll 14. The discharge scroll 14 is formed in a spiral shape in which a cross-sectional area thereof gradually expands in the circumferential direction. An outlet of the discharge scroll 14 is connected to a discharge nozzle 17.

The intermediate suction flow path 10 that additionally supplies the second gas G2 to a second impeller 3*b* of the second compression stage 22 is connected to the flow path 6 between the first compression stage 21 and the second compression stage 22. The intermediate suction flow path 10 is connected to the radially inner side of the introduction flow path 25 in the second compression stage 22 (the upstream side of the second impeller 3*b* in the second compression stage 22). A plurality of straightening vanes 35 which straighten the second gas G flowing through the intermediate suction flow path 10 are provided on the radially inner side of the intermediate suction flow path 10.

The intermediate suction flow path 10 is formed so that the radially outer side thereof which is the upstream side is connected to the intermediate suction nozzle 16 and the radially inner side thereof which is the downstream side is connected to the curved flow path 26 of the second compression stage 22. The intermediate suction flow path 10 is formed adjacent to the introduction flow path 25. The intermediate suction flow path 10 and the introduction flow path 25 are partitioned by a partition wall 36.

The intermediate suction flow path 10 of the embodiment is formed so that the gas G having a flow rate larger than that in the suction flow path 9 can flow therein.

A first impeller 3*a* and a first return flow path 29*a* constituting the first compression stage 21 of the embodiment are disposed on the radially inner side of the first casing 19. That is, an outer diameter of the first return flow path 29*a* is equal to or less than an inner diameter of the first casing 19.

The intermediate suction flow path 10, the second compression stage 22, the third compression stage 23, and the discharge scroll 14 of the embodiment are disposed on the radially inner side of the second casing 20. That is, an outer diameter of the intermediate suction flow path 10, an outer diameter of the second return flow path 29*b*, and an outer diameter of the discharge scroll 14 are equal to or smaller than an inner diameter of the second casing 20.

The outer diameter of the intermediate suction flow path 10 is formed by the inner circumferential surface 20*a* of the second casing. Since the intermediate suction flow path 10 is disposed on the radially inner side of the second casing 20 having the outer diameter larger than the outer diameter of the first casing 19, the flow path cross-sectional area of the intermediate suction flow path 10 is increased.

The outer diameter of the discharge scroll 14 is the outer diameter of the spiral portion of the discharge scroll 14 and is an outer diameter of a portion other than a linear portion connected to the discharge nozzle 17.

Next, an operation of the centrifugal compressor 1 of the embodiment will be described.

In the centrifugal compressor 1 in a normal operating state, the gas G behaves as follows.

First, the first gas G1 introduced into the flow path 6 from the suction nozzle 15 flows into the compression flow path 27 in the first impeller 3*a* via the introduction flow path 25 of the first compression stage 21. Since the impeller 3 rotates around the axis O with rotation of the rotating shaft 2, a centrifugal force directed radially outward from the axis O is added to the gas G in the compression flow path 27. In addition, as described above, since the cross-sectional area of the compression flow path 27 gradually decreases from the radially outer side to the inner side, the gas G is gradually compressed. Accordingly, the high-pressure gas G is delivered from the compression flow path 27 to the subsequent diffuser flow path 28.

The high-pressure gas G flowing out from the compression flow path 27 sequentially passes through the diffuser flow path 28, the return flow path 29, and the introduction flow path 25 in order. Thereafter, the same compression is also applied to the impeller 3 of the second compression stage 22. Further, the second gas G2 is added to the second impeller 3*b* of the second compression stage 22 via the intermediate suction nozzle 16 and the intermediate suction flow path 10.

Eventually, the gas G reaches a desired pressure state and is supplied from the discharge nozzle 17 to an external device which is not shown in the drawing.

According to the above-described embodiment, it is possible to reduce the cost while improving the efficiency of the centrifugal compressor 1. That is, since the flow path cross-sectional area of the intermediate suction flow path 10 in which the pressure of the gas G is high and the flow rate of the gas G is increased can be increased, the flow velocity can be lowered and the friction loss can be reduced. On the other hand, it is possible to reduce the cost of the centrifugal compressor 1 by setting the outer diameter of the first casing 19 to be smaller than that of the second casing 20 in consideration of the pressure of the gas G and the flow rate of the gas G.

Further, it is possible to more uniformly distribute the flow rate and flow velocity of the gas G in the intermediate suction flow path 10 by increasing the flow path cross-sectional area of the intermediate suction flow path 10.

Further, it is possible to increase a curvature of the discharge scroll 14, and it is possible to minimize separation of the gas G flowing through the discharge scroll 14.

In the above-described embodiment, to increase the curvature of the discharge scroll 14, the outer diameter of the casing 4 disposed on the radially outer side of the discharge scroll 14 is increased, but the present invention is not limited thereto. For example, the outer diameter of the casing 4 disposed on the radially outer side of the discharge scroll 14 may be reduced as long as separation does not occur even if the outer diameter of the discharge scroll 14 is reduced.

Although embodiments of the present invention have been described in detail, various modifications can be made without departing from the technical idea of the present invention.

For example, a compression stage may be added between the first compression stage 21 and the second compression stage 22 in the above-described embodiment.

Further, a compression stage configured to compress some of the gas G discharged from the third compression stage 23 and a discharge nozzle 17 may be further added.

INDUSTRIAL APPLICABILITY

According to the present invention, it is possible to reduce the cost while improving the efficiency of the centrifugal compressor. That is, since the flow path cross-sectional area of the intermediate suction flow path in which the pressure of the gas is high and the flow rate of the gas is increased can be increased, the flow velocity can be lowered and the friction loss can be reduced. On the other hand, it possible to reduce the cost of the centrifugal compressor by reducing the outer diameter of the first casing to be smaller than that of the second casing in consideration of the pressure of the gas and the flow rate of the gas.

DESCRIPTION OF REFERENCE NUMERALS

1 Centrifugal compressor
2 Rotating shaft
3 Impeller
3*a* First impeller
3*b* Second impeller
3*c* Third impeller
4 Casing
5 Diaphragm
6 Flow path
7 First casing head
8 Second casing head
9 Suction flow path
10 Intermediate suction flow path
14 Discharge scroll
15 Suction nozzle
16 Intermediate suction nozzle
17 Discharge nozzle
19 First casing
20 Second casing
21 First compression stage
22 Second compression stage
23 Third compression stage
25 Introduction flow path
26 Curved flow path
27 Compression flow path
28 Diffuser flow path
29 Return flow path
30 Return vane
34 Inlet guide vane
35 Straightening vane
D Axial direction
D1 Upstream side
D2 Downstream side
G Gas
O Axis

The invention claimed is:

1. A centrifugal compressor comprising:

a rotating shaft;

a first casing which forms a cylindrical shape;

a second casing which forms a cylindrical shape, is disposed on a downstream side of the first casing to be coaxial with the first casing, and has an outer diameter larger than an outer diameter of the first casing;

a first impeller which is provided on the rotating shaft and disposed on a radially inner side of the first casing;

a first return flow path which is disposed on a radially inner side of the first casing and guides a fluid flowing to a radially outer side from the first impeller toward a radially inner side;

a second impeller which is provided on the rotating shaft, disposed on a radially inner side of the second casing, and connected to a downstream side of the first return flow path;

an intermediate suction flow path which is disposed on the radially inner side of the second casing and additionally supplies the fluid to a flow path between the first return flow path and the second impeller; and a second return flow path which is disposed on the radially inner side of the second casing and guides the fluid flowing to the radially outer side from the second impeller toward the radially inner side, wherein an outer diameter of the intermediate suction flow path and an outer diameter of the second return flow path are larger than the outer diameter of the first casing.

2. The centrifugal compressor according to claim 1, further comprising:

a third impeller which is provided on the rotating shaft, disposed on the radially inner side of the second casing, and connected to a downstream side of the second return flow path; and a discharge scroll which is disposed on the radially inner side of the second casing and in which the fluid flowing to the radially outer side from the third impeller is introduced, wherein an outer diameter of the discharge scroll is larger than the outer diameter of the first casing.

* * * * *